US008877313B2

(12) United States Patent
Larsson

(10) Patent No.: US 8,877,313 B2
(45) Date of Patent: Nov. 4, 2014

(54) STACK OF INTERFOLDED HYGIENE PRODUCTS

(75) Inventor: Björn Larsson, Billdal (SE)

(73) Assignee: SCA Hygiene Products AB, Göteborg (SE)

( * ) Notice: Subject to any disclaimer, the term of this patent is extended or adjusted under 35 U.S.C. 154(b) by 0 days.

(21) Appl. No.: 14/131,470

(22) PCT Filed: Jul. 13, 2011

(86) PCT No.: PCT/EP2011/061939

§ 371 (c)(1),
(2), (4) Date: Jan. 8, 2014

(87) PCT Pub. No.: WO2013/007303

PCT Pub. Date: Jan. 17, 2013

(65) Prior Publication Data

US 2014/0134376 A1 May 15, 2014

(51) Int. Cl.
*A47K 10/16* (2006.01)
*B65H 45/24* (2006.01)

(52) U.S. Cl.
CPC ..... *B65H 45/24* (2013.01); *A47K 10/16* (2013.01)
USPC ..... 428/43; 428/100; 428/126; 428/194

(58) Field of Classification Search
CPC ..... B65D 83/0894
USPC ..... 428/43, 124, 126, 194, 100; 221/48
See application file for complete search history.

(56) References Cited

U.S. PATENT DOCUMENTS

2003/0091786 A1 5/2003 Mansson

FOREIGN PATENT DOCUMENTS

WO WO 00/00072 A1 1/2000
WO WO 02/096255 A1 12/2002

OTHER PUBLICATIONS

International Search Report (PCT/ISA/210) mailed on Nov. 13, 2011, by the European Patent Office as the International Searching Authority for International Application No. PCT/EP2011/061939.
Written Opinion (PCT/ISA/237) mailed on Nov. 13, 2011, by the European Patent Office as the International Searching Authority for International Application No. PCT/EP2011/061939.

*Primary Examiner* — Alexander Thomas
(74) *Attorney, Agent, or Firm* — Buchanan Ingersoll & Rooney PC

(57) ABSTRACT

A stack of interfolded hygiene products (100), including a first web (1) divided into individual hygiene products by means of lines of weakness (12); a second web (2) divided into individual hygiene products by means of lines of weakness (22); the first web and the second web being interfolded with one another in a nested configuration, wherein the lines of weakness of the first web and the lines of weakness of the second web are offset with respect to one another along the webs; the first web and the second web are joined to one another at a leading portion (4) and/or at a trailing portion (4") of the webs.

14 Claims, 2 Drawing Sheets

STACK OF INTERFOLDED HYGIENE PRODUCTS

TECHNICAL FIELD

The present application pertains to a stack of interfolded hygiene products, in particular to a stack of interfolded tissue paper products and/or to a stack of interfolded paper as non-woven hygiene products, typically in the form of towels, napkins and/or wipes.

TECHNOLOGICAL BACKGROUND

In the field of dispensing hygiene products from a stack of interfolded hygiene products, several possibilities of actually interfolding the hygiene products are known. A type of dispenser frequently encountered in the washrooms of airports, restaurants or other settings with a high frequency of customers is a dispenser from which the paper towels are withdrawn from stacks of interfolded paper towels. The paper is typically interfolded in a C- or Z-configuration and it is intended that the user, when withdrawing one of the papers from the respective dispensing opening of the dispenser, grasps the leading end of the paper and pulls it out of the dispensing opening. The intention of the Z-, V-, W- or C-shaped interfolding arrangement of the papers is that by withdrawing the leading paper, the next paper is automatically placed into its dispensing configuration. In particular, it is intended that its leading end is situated at the dispensing opening or even sticking out of the dispensing opening, such that it can be easily reached by the user.

However, this type of interfolded paper suffers the disadvantage that the leading end of the paper is not always in the right position for a user to be easily grasped. Accordingly, it happens from time to time that the user reaches through the dispensing opening and pinches the paper towels that are available there. In this situation, the user typically withdraws more than one single paper, and often pinches quite a number of papers, leading to waste of paper and untidy washrooms. This effect is particularly experienced when the stack of paper to be dispensed is squeezed into the dispenser such that the pressure on the lowest paper towels is relatively high. This situation is often encountered when the service personnel is not aware of the detrimental effects of squeezing the stack of paper into the dispenser.

In order to overcome this disadvantage, stacks of interfolded hygiene products have been suggested in which two webs, each comprising connected individual hygiene products, are provided in an interfolded manner. The individual hygiene products are connected to one another by means of tabs. Or, to put it the other way round, individual hygiene products are defined by perforating a web of material such that the individual hygiene products are connected to one another by the tabs remaining after perforation.

The two sheets are interfolded with respect to one another in a zigzag manner, such that they are substantially parallel to one another, and are provided in a nested configuration. The tabs/perforations of one web are offset with respect to the tabs of the other web.

When a user pulls the leading individual hygiene product, the respective web tears at the tabs to release the individual hygiene product, and, at the same time, the second web is forwarded to the respective dispensing opening such that its leading end can be easily reached by the user.

In other words, dispensing one sheet from one of the webs automatically feeds the next sheet of the other web into the dispensing position. A stack of interfolded dispenser napkins of this type is disclosed in WO 00/00072 A1.

However, when placing a new stack of these hygiene products on top of an almost used up stack of paper when refilling a dispenser, the same disadvantages as in the case of C-folded or Z-folded single paper sheets is experienced at the leading end of the new stack. In particular, a user, when attempting to find the leading end of the new stack of interfolded paper after the last paper of the previous stack has been dispensed, likewise reaches inside the dispensing opening, pinches a number of papers and just pulls them out. In the worst case, the user does not understand the concept of the two parallel webs and pulls out a considerable amount of paper before, eventually, both webs tear at the respective tabs and the stack is in its intended dispensing position.

SUMMARY

Accordingly, it is an object of the present disclosure to improve the dispensing properties of a stack of interfolded hygiene products when refilling a dispenser.

According to an exemplary solution, the stack of interfolded hygiene products comprises a first web, the first web being divided into individual hygiene products by lines of weakness extending laterally across the first web and a second web divided into individual hygiene products by lines of weakness extending laterally across the second web. The first web and the second web are interfolded in a nested configuration and are arranged such that the lines of weakness in the first web are offset with respect to the lines of weakness in the second web in the longitudinal direction of the web. In order to solve the above-mentioned problem, the first web and the second web are joined to one another in a leading portion and/or a trailing portion of the interfolded webs of the stack of hygiene products.

By means of the joint between the first web and the second web in a leading portion and/or a trailing portion of the interfolded webs of the stack of hygiene products it becomes possible to connect two separate stacks of hygiene products, for example when refilling a dispenser, in an easy manner. In particular, by means of joining the first web and the second web to one another, which is, at the first glimpse, contrary to the idea of the provision of the two separate but interfolded webs, it becomes possible to connect the trailing end of the stack of hygiene products with the leading end of the second stack of hygiene products at only one limited section of the respective stacks. In particular, it becomes possible to connect the two stacks by placing a connecting means on top and/or at the bottom of the stack and connect the two stacks accordingly.

When it is intended to provide a continuous dispensing action, it would be necessary, in a conventional stack of hygiene products, to connect the first web of the first stack with the first web of the second stack and the second web of the first stack with the second web of the second stack. However, this laborious task can be avoided by means of the provision of the joint between the two webs at the leading end and/or the trailing end.

When the first stack is about to be depleted, the connection between the first stack and the second stack will be pulled through the dispensing opening of the dispenser and the second stack will then advance into a position ready to be dispensed in a conventional manner of the interfolded stack arrangement. In other words, the problems that might occur when simply placing a refill stack of interfolded paper onto an almost finished stack of paper can be avoided and, at the same time, it becomes easily possible to connect the two stacks without any big hassle.

The stack may include three or more webs, in which case a joint is placed at the leading and/or trailing of the stack between each web.

In an embodiment, the joint between the first and second webs at the leading and/or at the trailing portion of the web is provided by a hook and/or loop fastener component, an adhesive or glue layer, or other such means (for example, three is a type of material in which minute hooks are densely packed on a substrate and one shaped so that they can bond with a corresponding material by hook to hook interaction (e.g. 3M's Dual Lock)). The joint may, for example be provided in the form of at least one tape, such as double sided tape, or tape with one adhesive side and one side with another fastener, such as a mechanical fastener. One particular means for providing the joints may be embossing the first and second webs together, such as by knurling or microembossing.

The joint may be provided in an elongate shape such as an elongate strip that extends longitudinally or laterally with respect to the elongate webs, or in some other direction. The elongate shape may be provided by a continuous line of material, e.g. adhesive, or discrete spaced portions of material, such as spats. The joint may extend 0.1 to 1 times the longitudinal or lateral extent of a folded product of the first and second webs (or 0.2, 0.3, 0.4, 0.5, 0.6 or even 0.7 to 1 times the dimension of the individual product). The first and second webs may include a plurality of joints connecting them at the leading and/or the trailing portion. For example, there may be provided a plurality of longitudinally extending joints, one laterally and one longitudinally extending joint, a combination of longitudinally extending joints and a laterally extending joint, etc. In an embodiment, a laterally extending joint is centrally positioned.

In an embodiment, the joint is provided in a peripheral margin of an individual product of the webs. In particular, the joint or joints may extend longitudinally and be provided in one or both of the lateral margins of the webs.

In an embodiment, material forming the joint, such as glue, is further provided so as to join at least each of the first 1, 2, 3, 4 or 5 leading and/or trailing products of the first web to the second web. In an embodiment, the material forming the joint is further provided so as to be distributed throughout the stack, so as to join at least every fourth, every third or every second product of the first web to the second web or perhaps even every product in one of the webs in the stack is joined to the other web. This latter feature is particularly useful for upwards dispersing as described below and supporting the lines of weakness.

Preferably, the leading portion and/or the trailing portion have an extension along the length of the webs of 0.5 to 1 times the length of an individual hygiene product. These dimensions ensure that only a limited amount of hygiene products is used for the connection of two stacks.

Preferably, a connecting means is provided at the top, at the bottom and/or at the sides of the respective stack of hygiene products, preferably close to the leading edge of the leading portion or to the trailing edge of the trailing portion of the webs. The connecting means may be in strip form, such as tape. The connecting means may be provided in the form of an adhesive pad, a mechanical fastener such as hook and loop fastener or a hook fastener that can attach to a corresponding hook fastener (e.g. 3M's Dual Lock®) and/or a magnet. The hook and hook fastener alternative may be in the form of a substrate having at least 10, 15, 20, 25, 30, 35, 40, 45, 50 hooks per square centimeter on one side and adhesive on the other side and such hooks are generally mushroom form. The connecting means is provided for connecting the stack to an adjacent stack in the dispensing sequence so that as a web of one of the stacks is pulled through a dispensing opening, a web of the other stack is pulled through with it by function of the connecting means.

In a preferred embodiment, the trailing portion is folded towards the side of the stack and/or the leading portion is folded towards the side of the stack in a manner such that a connecting means is situated such that it points towards the outside.

This feature of the disclosure is also independently applicable to achieve the advantage of allowing side by side stacking and continuous feeding. Thus, there may be provided a stack of interfolded hygiene products, such as paper towels, wherein a trailing or leading portion of the stack is positioned to extend along a side of the stack in the stacking direction and includes a connecting means for securing the trailing or leading to a leading or trailing portion of a second stack that has the leading or trailing portion positioned to extend along the side of the stack in the stacking direction so that when the stacks are placed side by side rather than aligned in the stacking direction and the trailing portion of one of the stacks is pulled through a dispensing path, the leading portion of the adjacent stack is pulled into the dispensing path with it.

In another preferred embodiment, the first web and the second web are joined to one another by means of a banderole which is joined to both webs and which extends further beyond both webs. The banderole can be particularly suitable for a stack in which the leading portion and/or the trailing portion are folded towards the sides. Furthermore, the provision of a banderole in this arrangement integrates the function of packaging the stack as well as connecting the stack to another stack such that a continuous dispensing action can be achieved. When using a banderole in this arrangement, a connecting means would be situated on top or at the bottom of the stack by situating it on top or at the bottom of the banderole as long as it is still wrapped around the stack.

In another aspect of the present disclosure, there is provided a dispenser comprising a stack as defined above, wherein the dispenser comprises a stack housing for containing the stack in the dispenser, and a web feed path for feeding the first and second webs of the stack to a dispensing opening such that the webs of the stack leave the remainder of the stack and pass into the dispensing path from the top of the stack so that the portion of the webs being dispensed is able to be pulled through the dispensing path and the dispensing opening free from the weight of the remainder of the stack. The bottom of the stack is the end against which the weight of the stack bares. In such an upward type dispensing dispenser, joining of the first and second webs at the leading end of the stack is a particularly useful feature because it is during upward dispensing that the risk of web fallback occurs. In a downward dispensing dispenser, web fallback at the leading end of the stack does not occur since the leading end is being pulled out through the dispensing opening with gravity, whereas in an upwards dispensing dispenser, the leading portion of the stack is being dispensed against gravity, along at least a part of the dispensing path.

In an embodiment, the dispensing path could be provided by at least one guide member about which the webs are to be wrapped along the path from the stack housing to the dispensing opening. In an embodiment, a nip is formed adjacent the dispensing opening as part of the dispensing path and is configured to hold the first and second webs in a pinched condition for preventing the webs from moving away from the dispensing opening.

Upwards dispensing type dispensers are known from, for example, U.S. Pat. No. 4,516,711, WO 2006/071148A1 and US 2011/0101020.

BRIEF DESCRIPTION OF THE FIGURES

The present disclosure will be described in more detail below, with reference to the Figures, in which.

DETAILED DESCRIPTION OF THE PREFERRED EMBODIMENTS

Figure 1:
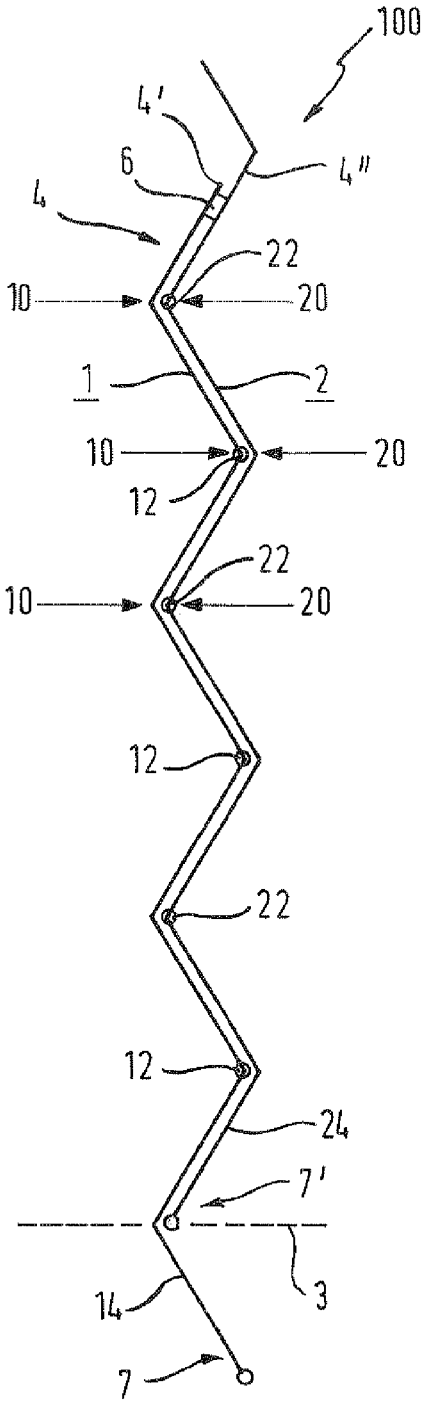
FIG. 1 is a schematic view of an interfolded stack of hygiene products being comprised of two interfolded webs.

In the following, embodiments of the stack of interfolded hygiene products according to the present disclosure will be described by reference to the attached Figures. Identical or similar features will be denoted by the same reference numerals and repeated description thereof may be omitted in order to avoid redundancies.

FIG. 1 shows the general principle of the interfolded hygiene products of the present type. A first web 1 is provided which is folded in a zigzag manner at folding positions 10. A second web 2 is provided, also folded in a zigzag manner. The second web 2 is likewise folded at folding positions 20, which correspond to the folding positions 10 of the first web 1. The first web 1 and the second web 2 are interfolded in a nested configuration. In other words, web 1 and web 2 substantially extend parallel to one another in the longitudinal direction of the webs 1,2 and the folding positions 10 of the first web 1 are substantially situated at the same positions as the folding positions 20 of the second web 2.

Web 1 includes lines of weakness 12, which are situated, in the embodiment shown in FIG. 1, at the positions of every second folding position 10. At the lines of weakness 12, individual hygiene products, for example in the form of an individual tissue paper towel or an individual nonwoven sheet, can be separated from the remainder of the web 1.

The second web 2 also includes lines of weakness 22 which are likewise positioned at every second folding position 20. The lines of weakness 22 of the second web 2 are offset with respect to the lines of weakness 12 of the first web 1 by one distance between the respective folding positions 10, 20. In other words, at the position of the lines of weakness 12 of the first web 1 the second web 2 does not show lines of weakness, and at the positions of the lines of weakness 22 of the second web 2 the first web 1 does not show lines of weakness.

Accordingly, when a user withdraws an individual hygiene product from the interfolded webs 112, the individual hygiene product will tear at the respective lines of weakness 12 or 22.

At reference numeral 3, the plane of a dispensing opening of a dispenser is schematically shown. A user takes the leading end 7 of one of the interfolded webs 1, 2, which is provided in FIG. 1 by web 1. This leading end 7 is situated below the dispensing opening 3 such that an individual hygiene product 14 can be reached by the user in order to withdraw an individual hygiene product from the stack of interfolded hygiene products 100. Due to the nested and parallel configuration of the first web 1 and the second web 2, by pulling the leading end 7 of the web 1, not only the first web 1 but also the second web 2 is advanced through the dispensing opening 3 until the individual hygiene product 14 gripped by the user tears at the line of weakness 12. By this time, a new leading end 7' will be established, this time at the end of the second web 2. This new leading end 7' is then ready to be fully dispensed through the dispensing opening 3.

The next time a user pulls out a hygiene product 24 at the new leading end 7' of the second web 2, this will automatically transport the subsequent leading end of the first web 1 into its dispensing position. In other words, withdrawing an individual hygiene product from one web transports the respective other web into its dispensing position.

Figure 2:
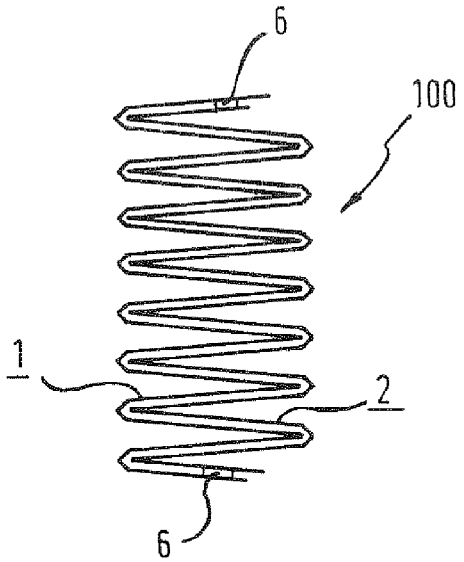
FIG. 2 is a schematic view of a stack of interfolded hygiene products.

The arrangement shown in FIG. 1 in a stretched view, which was chosen to clearly show the relationship between the first web 1 and the second web 2, is now shown in FIG. 2 in a rather compressed manner.

In a dispenser, if the stack of interfolded hygiene products 100 is about to be fully dispensed, the respective service personnel will place a refill stack on top of the almost dispensed stack. This situation is shown, schematically, in FIG. 3 in which two stacks 102 and 104 are placed on top of one another. In order to achieve constant dispensing at the transition from the first stack to the refill stack, the two stacks 102 and 104 are connected by a connecting means 5. This connecting means 5 could be, for example, a strip of Velcro tape, a strip of adhesive, a magnet or any other means that is suitable to connect the almost dispensed stack 102 to the refill stack 104.

Turning back to FIG. 1, it is shown in the upper part of this Figure that the respective trailing ends 4', 4" of the first web 1 and the second end 2 are joined to one another at the common trailing portion 4 by means of a joint 6. The same joint between the first web 1 and the second web 2 can be provided at the leading portion of the stack of interfolded hygiene products 100 (not shown in FIG. 1).

The joint 6 can be achieved by gluing the first web 1 and the second web 2 together at the leading portion and/or the trailing portion by means of edge embossing between the two by means of a Velcro fastener between the two webs, or by any other suitable means of joining the first web and the second web at the leading portion and/or the trailing portion of the web.

The term "leading portion" or "trailing portion" is intended to refer to a short portion relative to the entire length of the web, the portion being situated at the beginning of the two webs or at the end of the two webs. The short portion may include from only a few percent of an individual hygiene product up to several individual hygiene products.

Typically, edge embossing or a strip of glue for connecting the two webs 1, 2 extends along the length of 0.5 to 1 times the length of an individual hygiene product. However, depending on the length of the connection, a shorter length can also be realised.

The joint between the two webs necessarily needs to have a length that is suitable to provide for a secure connection between the two webs 1, 2. The joint also should have a certain strength that permits dispensing the two webs 1, 2 together through a dispensing opening while only applying a force to the outer side of one of the webs.

Figure 3:
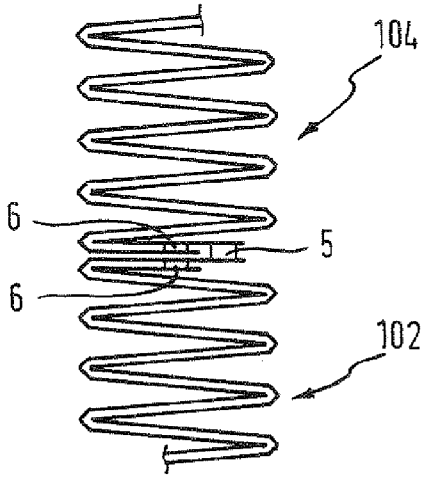
FIG. 3 is a schematic view of two stacks of interfolded hygiene products placed on top of one another.

This situation is shown, for example, in FIG. 3. In particular, the joint 6 between the two webs 1, 2 which is provided at the trailing portion 4 of the interfolded stack of hygiene products 102 and which is provided at the leading portion 4 of the refill stack 104 in FIG. 3 is provided such that when forming the connection by means of the connecting means 5 between the stacks 102, 104, the leading portion of the refill stack 104 will be pulled through the dispensing opening together with the last sheets of hygiene products of the previous stack 102.

It is appreciated that the portion of the webs where the two stacks 102, 104 are actually connected to one another might not be suitable for drying the hands in the conventional way because quite a volume of hygiene products is withdrawn. In this situation, typically 4 individual sheets are withdrawn at the same time. It is, however, accepted that a user who withdraws from a dispenser the portion at which the connection is established throws away this piece of hygiene product without using it. It is appreciated that this possible waste of material greatly outweighs the material that would be wasted if no such connection between the stacks 102, 104 were present.

By means of the joint 6 between the two webs, it becomes possible to use a very simple connecting means 5 which is placed substantially on a top surface of the stack 102 and on a bottom surface of the stack 104, such that when pulling the refill stack 104 on top of the almost dispensed stack 102, the connection between the two stacks is automatically established, without the need for any further action of the service personnel.

Figure 4:
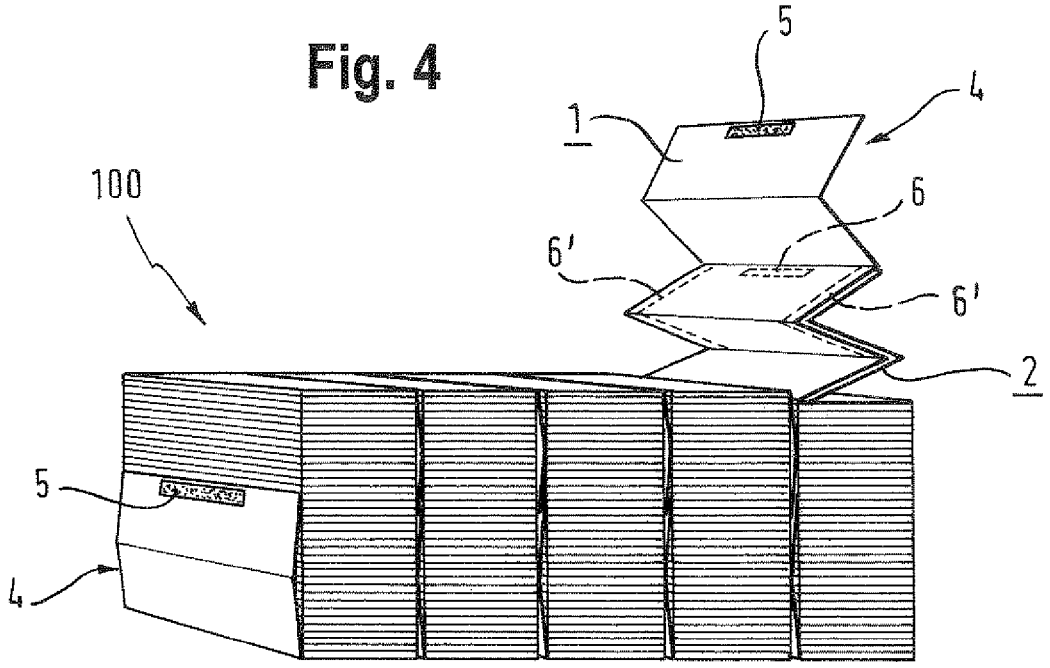
FIG. 4 is a schematic, perspective view of five stacks of hygiene paper placed besides one another.
Figure 5:
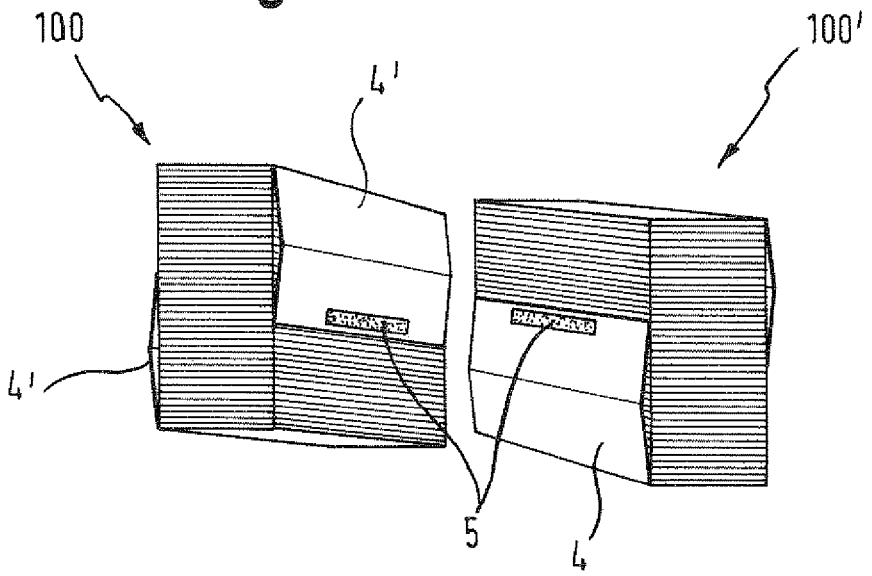
FIG. 5 is a schematic, perspective view of two stacks of hygiene products having their respective trailing and leading portions folded towards the sides of the stacks.

FIGS. 4 and 5 show a different embodiment in which the leading portion 4 of the respective stack 100 of interfolded hygiene products is folded to one of the sides of the stack 100.

The term "side of the stack" is to be understood in a sense in that the sides of the stack are defined by the plane extending through the respective folding edges of the webs on one side of the stack which define the stack as such. In other words, the sides of the stack are the sides from which normal dispensing does not take place. The stack is generally an oblong structure formed by two long sides and two short sides connecting top and bottom surfaces defining leading and trailing ends of the stack. In the embodiments shown in FIGS. 4 and 5 the sides are the long side. However, it is also contemplated to place the leading portion and/or the trailing portion onto the short side of the stack.

The leading end 4 of the stack 100 is folded to one side of the stack 100 in FIG. 4 such that the connecting means 5, which is situated close to the leading edge of the leading portion 4 is substantially placed at the middle of the side. As shown in FIG. 5, the trailing portion of the stack 100 is likewise folded to the side, in particular to the opposite side to that of the leading portion 4. Accordingly, if two stacks were placed closely besides one another in the form as shown in FIG. 4, the respective connecting means 5 would automatically connect to one another such that the leading portion 4 of the second stack 100' in FIG. 5 would be connected to the opposite connecting means of the trailing portion 4' of the first stack 100.

Accordingly, in the arrangement shown in FIG. 4, this leads to a situation in which paper can be dispensed continuously throughout all stacks. This dispensing process starts from the right-hand side stack, in which dispensing of paper is shown at a leading portion 4, and the entire interfolded paper would then be connected down to the last sheet of paper of the last stack on the left-hand side in FIG. 4.

In FIG. 4 it can be also clearly seen that the first web 1 and the second web 2 are joined to one another by means of the joint 6, which is provided in the form of an adhesive strip. However, as an alternative to FIG. 4, it is also shown that the first web 1 and the second 2 are joined to one another by means of edge embossing 6'.

The reasoning behind joining the first web and the second web at the leading portion and the trailing portion of the respective stack is that the two webs of the stack can be easily connected to the two webs of a second stack by just a single connecting means.

In a case in which the joint between the first web and the second web were not present, it would be necessary, in order to establish a connection between the first web and the second web of the first stack and the first web and the second web of the second stack to connect the first web of the first stack to the first web of the second web and to connect the second web of the first stack, to the second web of the second stack. This is, however, impossible to achieve automatically or in an easy manner without involving major manual labour of the respective person servicing the respective dispenser.

Due to the joint 6 between the first web 1 and the second web 2 of the respective stacks, the connecting means 5 can be situated such that by simply placing a refill stack on top of the almost dispensed stack, a connection between the respective webs can be achieved. In the embodiment shown in FIGS. 4 and 5, the refill stack simply has to be placed next to the almost emptied other stacks.

Accordingly, by means of the joint between the first web and the second web it becomes possible to achieve simple and efficient refill of stacks of interfolded hygiene products without compromising the dispensing performance after refilling.

It is contemplated, in an alternative, to join the first web and the second web by means of a banderole which is actually joined to both webs and which extends further beyond both webs. The banderole can be particularly suitable for a stack in which the leading portion and/or the trailing portion are folded towards the sides. Furthermore, the provision of a banderole in this arrangement integrates the function of packaging the stack as well as connecting the stack to another stack such that a continuous dispensing action can be achieved. When using a banderole in this arrangement, a connecting means would be situated on top or at the bottom of the stack by situating it on top or at the bottom of the banderole as long as it is still wrapped around the stack.

In an alternative embodiment, the interfolding structure could be changed as compared to that disclosed in FIG. 1. In particular, the lines of weakness could be located between the folds. An exemplary such interfolding arrangement is shown in FIGS. 7 to 9 of the aforementioned WO 00/00072.

In an alternative to the use of two webs to make up the stack, there would be three or more webs that are interfolded with the lines of weakness of each web offset from the lines of weakness of the other webs. In such an embodiment, a joint is provided to connect each web to at least one other of the webs at the leading and/or trailing portion of the stack so that the webs can be pulled through a dispensing opening in common.

The invention claimed is:

1. Stack of interfolded hygiene products, comprising:

at least two webs, the webs including:

a first web divided into individual hygiene products by means of lines of weakness; and a second web divided into individual hygiene products by means of lines of weakness;

the first web and the second web being interfolded with one another so as to form a nested configuration, wherein the lines of weakness of the first web and the lines of weakness of the second web are offset with respect to one another along the webs;

wherein the first web and the second web are joined, at a joint, to one another at a leading portion and/or at a trailing portion of the webs.

2. Stack according to claim 1, wherein the joint between the first web and the second web is provided by an adhesive, by the application of edge embossing, the provision of hook and loop fasteners or hook and hook fasteners.

3. Stack according to claim 1, wherein the leading portion and/or the trailing portion have an extension along the length of the webs of 0.20 to 1 times the length of an individual hygiene product.

4. Stack according to claim 1, wherein a connecting means is provided at the leading portion and/or the trailing portion of the webs.

5. Stack according to claim 4, wherein the connecting means is provided in the form of an adhesive pad, a hook and loop fastener, or hook and hook fastener and/or a magnet.

6. Stack according to claim 4, wherein the connecting means is situated at the top surface, at the bottom surface and/or at sides of the stack.

7. Stack according to claim 1, wherein the leading portion and/or the trailing portion of the webs are folded towards the sides of the stack.

8. Stack according to claim 1, wherein the first web and the second web are joined to one another by means of a banderole being joined to both webs and extending further beyond both webs.

9. Stack according to claim 1, wherein the joint is provided in an elongate shape.

10. Stack according to claim 1, wherein the joint is provided in a peripheral margin of an individual product of the webs.

11. Stack according to claim 1, wherein the joint extends longitudinally and is provided in one or both of the lateral margins of the webs.

12. Stack according to claim 1, wherein the joint is provided in the form of tape.

13. Stack according to claim 1, wherein material forming the joint is further provided so as to join at least each of the first 1, 2, 3, 4 or 5 leading and/or trailing products of the first web to the second web.

14. Stack according to claim 1, the material forming the joint is further provided so as to be distributed throughout the stack, so as to join at least every fourth, every third, or every second product of the first web to the second web product.

* * * * *